US010464116B2

(12) United States Patent
Nakazawa et al.

(10) Patent No.: US 10,464,116 B2
(45) Date of Patent: Nov. 5, 2019

(54) METHOD OF MANUFACTURING PLATE-LIKE MOLDED BODY HAVING A PLURALITY OF THICKENED PORTIONS, AND PLATE-LIKE MOLDED BODY HAVING A PLURALITY OF THICKENED PORTIONS

(71) Applicant: NIPPON STEEL & SUMITOMO METAL CORPORATION, Tokyo (JP)

(72) Inventors: Yoshiaki Nakazawa, Tokyo (JP); Koichi Sato, Tokyo (JP); Kojiro Akiba, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 220 days.

(21) Appl. No.: 15/112,072

(22) PCT Filed: Mar. 27, 2015

(86) PCT No.: PCT/JP2015/059764
§ 371 (c)(1),
(2) Date: Jul. 15, 2016

(87) PCT Pub. No.: WO2015/147297
PCT Pub. Date: Oct. 1, 2015

(65) Prior Publication Data

US 2016/0332205 A1 Nov. 17, 2016

(30) Foreign Application Priority Data

Mar. 28, 2014 (JP) ..... 2014-069162

(51) Int. Cl.
*B21D 22/26* (2006.01)
*B21D 22/24* (2006.01)
*B21D 35/00* (2006.01)

(52) U.S. Cl.
CPC ..... *B21D 22/26* (2013.01); *B21D 22/24* (2013.01); *B21D 35/006* (2013.01)

(58) Field of Classification Search
CPC ..... B21D 22/20; B21D 22/22; B21D 22/24; B21D 22/26; B21D 22/30; B21D 25/02; B21D 24/04; B21D 24/10; B21D 35/006
See application file for complete search history.

(56) References Cited

U.S. PATENT DOCUMENTS 3,481,175 A * 12/1969 White ..... B21D 22/24 72/333
5,069,089 A 12/1991 Yasuno et al.
(Continued)

FOREIGN PATENT DOCUMENTS

CN 1974048 A 6/2007
CN 102716963 A 10/2012
(Continued)

OTHER PUBLICATIONS

Korean Office Action issued in corresponding Korean Application No. 10-2016-7025415 dated Oct. 16, 2017, together with a partial English translation.
(Continued)

*Primary Examiner* — Edward T Tolan
(74) *Attorney, Agent, or Firm* — Birch, Stewart, Kolasch & Birch, LLP

(57) ABSTRACT

[Object] To provide a method of manufacturing a plate-like molded body having a thickened portion in a region spaced apart from an edge in a substantially flat plate-like portion. [Solution] Provided is a method of manufacturing a plate-like molded body having a plurality of thickened portions, including at least a drawing step of obtaining by a drawing process a cylindrical drawn molded body including a flat plate portion and a cylindrical drawn portion that swells in such a manner as to project from the flat plate portion and
(Continued)

has a circular top portion. The drawing step includes a first step of pressing a region spaced apart from an edge in a plate-like member having a flat plate shape, with a first mold and a second mold, to form a concave curved portion in the plate-like member, and a second step of holding an outer circumferential section of the plate-like member between a third mold and a fourth hold while a region containing the concave curved portion in the plate-like member is held between the first mold and the second mold, and moving the first mold and the second mold relative to the third mold and the fourth mold to cause the region containing the concave curved portion to project with respect to the outer circumferential section and to obtain the cylindrical drawn molded body.

8 Claims, 9 Drawing Sheets

(56) References Cited

U.S. PATENT DOCUMENTS

| | | | | |
|---|---|---|---|---|
| 5,749,257 | A * | 5/1998 | McEldowney | B21D 51/383 72/354.6 |
| 7,490,503 | B1 * | 2/2009 | Kanemitsu | B21D 53/18 72/348 |
| 8,402,804 | B2 * | 3/2013 | Nakao | B21D 22/06 72/347 |
| 9,707,617 | B2 * | 7/2017 | Yamagata | B21D 22/24 |
| 10,022,763 | B2 * | 7/2018 | Tanaka | B21D 5/01 |
| 2002/0023474 | A1 * | 2/2002 | McClung | B21D 22/24 72/348 |
| 2006/0236741 | A1 | 10/2006 | Saitou | |
| 2007/0006628 | A1 | 1/2007 | Tabei et al. | |
| 2009/0272171 | A1 * | 11/2009 | Golovashchenko | B21D 22/24 72/348 |
| 2013/0037555 | A1 * | 2/2013 | Monro | B21D 22/30 220/608 |
| 2016/0214161 | A1 * | 7/2016 | Yamano | B21D 22/20 |
| 2016/0288186 | A1 * | 10/2016 | Ito | B21D 22/20 |

FOREIGN PATENT DOCUMENTS

| | | | |
|---|---|---|---|
| JP | 61-199524 | A | 9/1986 |
| JP | 2714179 | B2 | 2/1998 |
| JP | 3594845 | B2 | 12/2004 |
| JP | 2006-346703 | A | 12/2006 |
| JP | 2007-175765 | A | 7/2007 |
| JP | 2009-12044 | A | 1/2009 |
| JP | 2010-120062 | A | 6/2010 |
| JP | 4522378 | B2 | 8/2010 |
| JP | 2010-247199 | A | 11/2010 |
| JP | 2013-18016 | A | 1/2013 |
| KR | 10-1991-0005940 | A | 4/1991 |
| KR | 10-2006-0110793 | A | 10/2006 |

OTHER PUBLICATIONS

International Search Report for PCT/JP2015/059764 dated Jun. 30, 2015.

Written Opinion of the International Searching Authority for PCT/JP2015/059764 (PCT/ISA/237) dated Jun. 30, 2015.

Chinese Office Action and Search Report, dated Jul. 5, 2017, for corresponding Chinese Application No. 201580015372.4.

Korean Office Action and partial English translation for corresponding Korean Application No. 10-2016-7025415, dated Jun. 18, 2018.

* cited by examiner

METHOD OF MANUFACTURING PLATE-LIKE MOLDED BODY HAVING A PLURALITY OF THICKENED PORTIONS, AND PLATE-LIKE MOLDED BODY HAVING A PLURALITY OF THICKENED PORTIONS

TECHNICAL FIELD

The present invention relates to a method of manufacturing a plate-like molded body having a plurality of thickened portions, and particularly relates to a method including a step of molding a plate-like molded body by press processing.

BACKGROUND ART

Some plate-like members used in transport airplanes, construction structures, and the like are fastened to other members with bolts. FIG. 1 is a plan view illustrating an example of a plate-like member having a plurality of fastening portions. This plate-like member 1 has a substantially flat circular plate shape. The plate-like member 1 includes three fastening portions 2 in a region spaced apart from the margin. The plate-like member 1 is bolted to another member at the fastening portions 2.

When the surface of the plate-like member 1 serves as the bearing surface of the bolts, the fastening strength is influenced by the thickness around the fastening portions 2 of the plate-like member 1 to a large extent. When the fastening strength is required to be increased, it is necessary to either increase the thickness of the plate-like member 1 or to attach a reinforcing plate to the fastening portions 2.

However, when the thickness of the whole of the plate-like member is increased, the weight of the plate-like member markedly increases. When a product including the plate-like member is demanded to be decreased in weight, such demand cannot be satisfied. Furthermore, the use of the reinforcing plate increases the number of components, thereby raising the costs of management and assembling. To address these concerns, it is conceivable that only a necessary portion (in the example of FIG. 1, the fastening portions 2 and portions around the fastening portions 2) of the plate-like member is increased in thickness (hereinafter, also referred to as "thickened").

Patent Literature 1 discloses a thickening press process including: a previous step of deep-drawing a work; and a step of pressing the deep-drawn work to thicken a predetermined portion. Patent Literature 2 discloses a method of clamping a pressed work having an end wall and a bent portion that is bent from the outer circumference toward one side, at the bent portion from the outer circumference of this end wall, so that the bent portion is compressed in the radial direction for thickening. Patent Literature 3 discloses a method of manufacturing a molded component having a bent corner, including a thickening step of increasing in thickness of a corner by molding under pressure.

CITATION LIST

Patent Literature

Patent Literature 1: JP 3594845B
Patent Literature 2: JP 2010-247199A
Patent Literature 3: JP 2007-175765A

SUMMARY OF INVENTION

Technical Problem

However, the methods disclosed in Patent Literatures 1 to 3 are intended to thicken a bent portion or a portion adjacent to an edge in a plate-like member. Therefore, these methods cannot be applied to other portions, for example, when a region spaced apart from a margin is thickened in a substantially flat plate-like portion (that is, an unbent portion), like the fastening portions 2 illustrated in FIG. 1. In addition, Patent Literatures 1 to 3 do not indicate a method of thickening a plurality of regions (fastening portions and portions around the fastening portions) along a circumferential direction with respect to a center, like the plate-like member 1 illustrated in FIG. 1.

The present invention has been devised in view of the above-described problems. An object of the present invention is to provide a novel and improved plate-like molded body having a thickened portion in a region spaced apart from an edge in a substantially flat plate-like portion, and a method of manufacturing the plate-like molded body.

Advantageous Effects of Invention

In order to solve the above problems, according to an aspect of the present invention, there is provided a method of manufacturing a plate-like molded body having a plurality of thickened portions, including at least a drawing step of obtaining by a drawing process a cylindrical drawn molded body including a flat plate portion and a cylindrical drawn portion that swells in such a manner as to project from the flat plate portion and has a circular top portion. The drawing step includes a first step of pressing a region spaced apart from an edge in a plate-like member having a flat plate shape, with a first mold and a second mold, to form a concave curved portion in the plate-like member, and a second step of holding an outer circumferential section of the plate-like member between a third mold and a fourth hold while a region containing the concave curved portion in the plate-like member is held between the first mold and the second mold, and moving the first mold and the second mold relative to the third mold and the fourth mold to cause the region containing the concave curved portion to project with respect to the outer circumferential section and to obtain the cylindrical drawn molded body.

The first step may include forming the concave curved portion in a region corresponding to the top portion, and the second step may include setting a plurality of thickening target regions containing at least a part of the concave curved portion along a circumferential direction with respect to a specific center in a region corresponding to the cylindrical drawn portion, and performing a drawing process such that in a cross section that is vertical to the flat plate portion and contains the specific center, an actual length of the thickening target region becomes longer than an actual length of the thickened portion in the plate-like molded body.

The method may further include, after the drawing step, a thickening step of pressing the cylindrical drawn molded body such that an actual length of each of the thickening target regions in the cross section decreases, and the thickening target region and the flat plate portion finally become flat as a whole.

The concave curved portion may include a hole-like curved portion that is curved in a hole shape.

The concave curved portion may further include a ring groove-like curved portion that is curved in a groove shape and formed around the hole-like curved portion in such a manner as to have a polygonal shape as a whole when seen vertically to the flat plate portion.

The concave curved portion may include a ring groove-like curved portion that is curved in a groove shape and formed in such a manner as to have a polygonal shape as a whole when seen vertically to the flat plate portion.

The thickened portion may have a plate thickness with a thickening rate of 20% or more with respect to an initial plate thickness as a plate thickness of the cylindrical drawn molded body, and may have a length of five times or more the initial plate thickness in the cross section.

In order to solve the above problems, according to another aspect of the present invention, there is provided a plate-like molded body having a plurality of thickened portions, including a flat plate portion, and a cylindrical drawn portion that swells in such a manner as to project from the flat plate portion and has a circular top portion. When t [mm] is a standard plate thickness, a plate thickness ti [mm] of the thickened portion and a plate thickness td [mm] of a thinned portion having a smaller thickness than the standard plate thickness satisfy relational formulas below:

when $2.0<t<3.0$, $td \geq 0.9t$, $ti \geq 1.25t$, when $3.0<t<4.0$, $td \geq 0.9t$, $ti \geq 1.35t$, and when $4.0<t<5.0$, $td \geq 0.9t$, $ti \geq 1.45t$.

As described above, according to the present invention, there can be provided a plate-like molded body having a thickened portion in a region spaced apart from an edge in a substantially flat plate-like portion, and a method of manufacturing the plate-like molded body.

DESCRIPTION OF EMBODIMENTS

Figure 1:
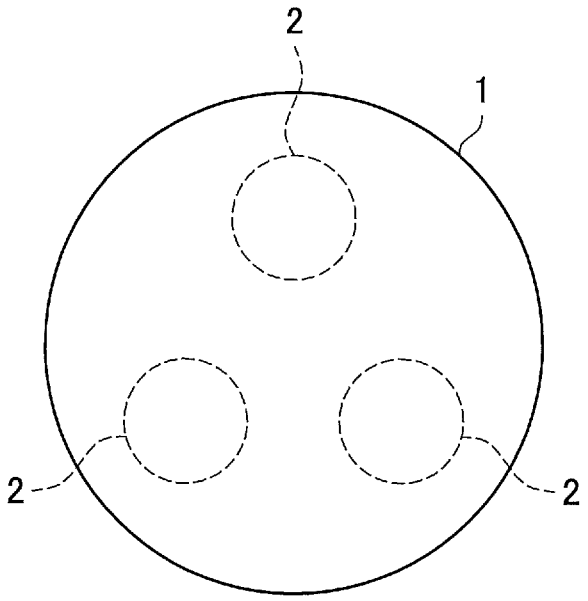
FIG. 1 is a plan view illustrating an example of a plate-like member.

Hereinafter, preferred embodiments of the present invention will be described in detail with reference to the appended drawings. Note that, in this specification and the appended drawings, structural elements that have substantially the same function and structure are denoted with the same reference numerals, and repeated explanation of these structural elements is omitted.

A method of manufacturing a plate-like molded body having a plurality of thickened portions according to the present embodiments includes a drawing step and a thickening step.

The drawing step is to obtain by a drawing process a cylindrical drawn molded body including a flat plate portion and a cylindrical drawn portion that swells in such a manner as to project from the flat plate portion and has a circular top portion. The drawing step includes: forming, in a region corresponding to the top portion, a concave curved portion containing a hole-like curved portion that is curved in a hole shape; setting a plurality of thickening target regions containing at least part of the concave curved portion along a circumferential direction with respect to a specific center in a region corresponding to the cylindrical drawn portion; and performing a drawing process such that an actual length of the thickening target region in a cross section that is vertical to the flat plate portion and contains the specific center becomes longer than an actual length of the thickened portion in the plate-like molded body.

The thickening step includes pressing the cylindrical drawn molded body such that an actual length of each of the thickening target regions in the cross section decreases, and the thickening target regions and the flat plate portion finally become flat as a whole.

Here, the "actual length" indicates a length along a surface of an object in a prescribed cross section of the object.

The thickening step may include a plurality of steps for pressing the cylindrical drawn molded body such that the actual length of each of the thickening target regions in the cross section decreases. In this case, the thickening target regions and the flat plate portion can be made in a flat state as a whole in at least one of these steps.

The material of the plate-like member is not particularly limited, but can be, for example, a high tensile steel plate having a tensile strength of 390 MPa or more. For example, the high tensile steel plate may have a tensile strength of 440 MPa or more.

The plate-like molded body manufactured by this manufacturing method can be used as, for example, a drive train component and a suspension attachment part. In this case, the thickened portions can serve as a portion to which a bolt is fastened.

Hereinafter, embodiments of the present invention will be described with reference to the drawings.

<First Embodiment>

In this embodiment, there is manufactured a plate-like molded body including three thickened portions formed around a center, such as a plate-like member 1 illustrated in FIG. 1 in which fastening portions 2 and portions around the fastening portions 2 are thickened.

Figure 2:
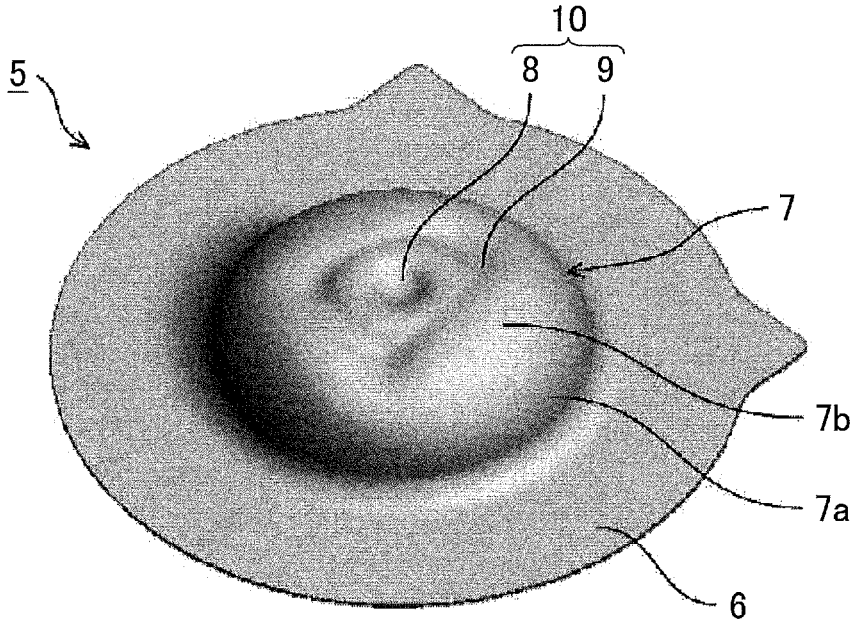
FIG. 2 is a perspective view of a cylindrical drawn molded body formed and used in a first embodiment.

FIG. 2 is a perspective view of a cylindrical drawn molded body formed in a drawing process. As illustrated in FIG. 2, a cylindrical drawn molded body 5 obtained in this step includes a flat plate portion 6 and a cylindrical drawn portion 7 that swells in such a manner as to project with respect to the flat plate portion 6.

In this embodiment, the cylindrical drawn portion 7 has a dome-like shape, and is approximately circular when seen vertically to the flat plate portion 6. The cylindrical drawn portion 7 includes a ring-shaped side portion 7*a* that rises from the flat plate portion 6, and a circular top portion 7*b*. The top portion 7*b* includes a concave curved portion 10 having a hole-like curved portion 8 that is curved in a hole shape and a ring groove-like curved portion 9 that is formed around the hole-like curved portion 8 and curved in a groove shape.

The ring groove-like curved portion 9 approximately has a shape of an equilateral triangle when seen vertically to the flat plate portion 6. In this embodiment, the formed ring groove-like curved portion 9 has a shape of a triangle corresponding to formation of three thickened portions. When N thickened portions are formed, a ring groove-like curved portion having an N-angular shape is formed. Although the ring groove-like curved portion 9 formed around the hole-like curved portion 8 has a single groove (one groove) in this embodiment, the ring groove-like curved portion 9 may have double or more grooves.

FIG. 3A to FIG. 3D are each a cross-sectional view for explaining the drawing step. In this step, a lower die (blank holder) 11 and a punch 12 as well as an upper die 13 and a pad 14 that are paired with and disposed above the lower die 11 and the punch 12 are used for press molding (a drawing process) to obtain the cylindrical drawn molded body 5 as an intermediate molded body.

In each of the following cross-sectional views (FIG. 3B, FIG. 3C, FIG. 4A to FIG. 4C, FIG. 5A to FIG. 5C, FIG. 6B, FIG. 6C, FIG. 8B, FIG. 8C, and FIG. 9A to FIG. 9C), an arrow indicates a moving direction of a mold.

A cylindrical hole penetrating in the vertical direction is formed in the lower die 11. The punch 12 is arranged in this hole. The relative positional relationship between the lower die 11 and the punch 12 is changed by the movement of the lower die 11 in the vertical direction. The upper surfaces of the lower die 11 and the punch 12 constitute a pressing surface 11*a* and a press surface 12*a*, respectively.

A columnar hole extending in the vertical direction and having a width smaller than the hole of the lower die 11 is formed in the upper die 13. The pad 14 is arranged in this hole and attached to the upper die 13 via a press spring or a gas cylinder, and is movable along the axial direction of this hole.

Of the lower surface of the upper die 13, the outer circumferential section constitutes a pressing surface 13*a* and faces the pressing surface 11*a* of the lower die 11, and the inner circumferential section constitutes a press surface 13*b* and faces the outer circumferential section of the press surface 12*a* of the punch 12. The lower surface of the pad 14 constitutes a press surface 14*a* and faces the central section of the press surface 12*a* of the punch 12. A load is applied to the pad 14 from the upper die 13 via a press spring or a gas cylinder. While such a load is not applied, the lower end of the pad 14 is positioned slightly lower than the height of the pressing surface 13*a*.

The pressing surface 11*a* of the lower die 11 and the pressing surface 13*a* of the upper die 13 are flat. The press surface 14*a* of the pad 14 and a region facing the press surface 14*a* in the press surface 12*a* of the punch 12 have a shape corresponding to the concave curved portion 10 (see FIG. 2) of the cylindrical drawn molded body 5. The press surface 13*b* and a region facing the press surface 13*b* in the press surface 12*a* have a shape corresponding to a portion other than the concave curved portion 10 in the cylindrical drawn portion 7.

Figure 3A:
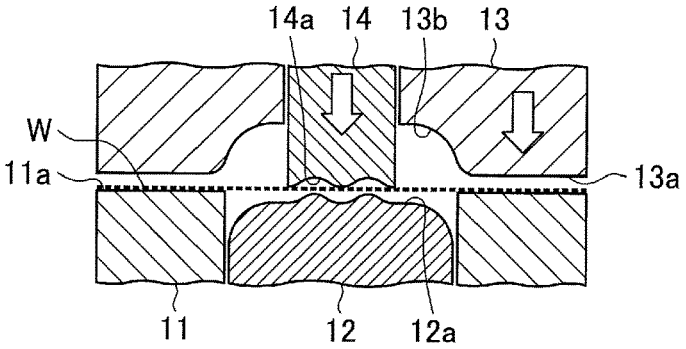
FIG. 3A is a cross-sectional view for explaining a drawing step in the first embodiment.
Figure 3B:
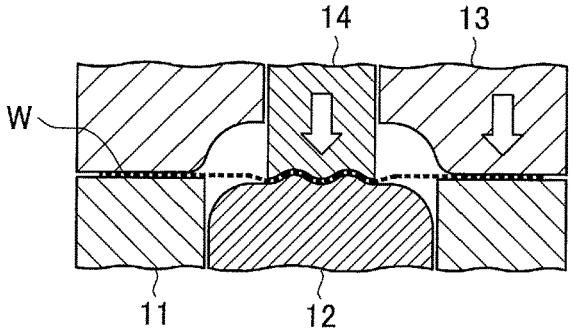
FIG. 3B is a cross-sectional view for explaining the drawing step in the first embodiment.

With reference to FIG. 3A, the height of the pressing surface 11*a* of the lower die 11 and the height of the upper end of the press surface 12*a* of the punch 12 are first aligned to be approximately the same. Then, for example, a plate-like member (hereinafter, also referred to as "work") W having a flat plate shape as a body to be processed is placed on the pressing surface 11*a* and the press surface 12*a*.

Next, the work W is held between the lower die 11 and the upper die 13 with a cushion force in the case of a single-acting press machine and with an acted outer load in the case of a double-acting press machine (a single-acting press machine in the drawing). At this time, the lower die 11 and the upper die 13 applies a force in an in-plane direction (referred to as "blank holding force" or "wrinkle suppressing force") to the work W to a degree that allows the work W to move.

Subsequently, the upper die 13 is moved downward. This allows the pad 14 attached to the upper die 13 to also move downward, and causes the lower end of the upper die 13 to be firstly brought into contact with the work W. Then, the upper die 13 is further moved downward, so that the work W is pressed with the punch 12 and the pad 14 with a pressure given by the pad 14. This allows formation of the concave curved portion 10 in the central section of the work W (see FIG. 3B). At this time, the height of the concave curved portion 10 in the work W is approximately the same as the height of the other section of the work W. Furthermore, the press surface 13*b* of the upper die 13 and the region facing the press surface 13*b* of the upper die 13 in the press surface 12*a* of the punch 12 are substantially spaced apart from the work W.

Thereafter, the upper die 13 is continuously moved downward while the work W is held between the punch 12 and the pad 14 for a drawing process. Accordingly, a cylindrical surface-like portion is formed in the work W (see FIG. 3C). In association with this, the work W between the lower die 11 and the upper die 13 is drawn into the inside, that is, into a space between the outer circumferential section of the press surface 12*a* and the press surface 13*b*. Since the drawing process is continued while the work W is held between the punch 12 and the pad 14, the material hardly flows from the space between the punch 12 and the pad 14 into the outer circumferential direction. As a result, the thickness of the work W within the space between the punch 12 and the pad 14 hardly decreases. In addition, since the work W is adequately pressed with the lower die 11 and the upper die 13, a wrinkle is unlikely to be generated in the work W even when the work W is pulled inward.

Figure 3C:
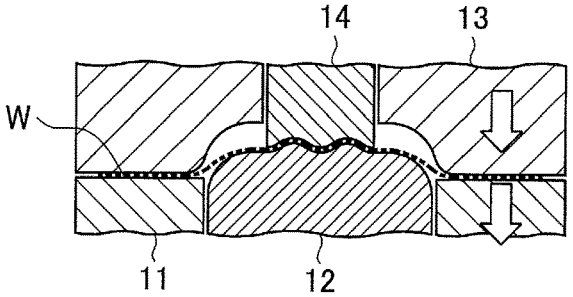
FIG. 3C is a cross-sectional view for explaining the drawing step in the first embodiment.
Figure 3D:
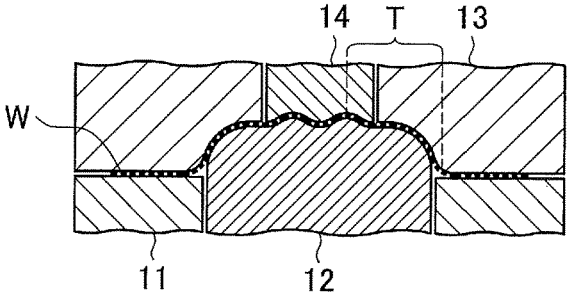
FIG. 3D is a cross-sectional view for explaining the drawing step in the first embodiment.

The upper die 13 is further continuously moved downward so that the work W is pressed with the press surface 13*b* and the outer circumferential section of the press surface 12*a* of the punch 12 (see FIG. 3D). This causes the portion between the pressing surface 11*a* of the lower die 11 and the pressing surface 13*a* of the upper die 13 in the work W becomes the flat plate portion 6. In addition, the portion between the press surface 12*a* of the punch 12, and the press surface 14*a* of the pad 14 and the press surface 13*b* of the upper die 13 becomes the cylindrical drawn portion 7. In this manner, the cylindrical drawn molded body 5 (see FIG. 2) is obtained.

In the cross section illustrated in FIG. 3D, about a right half in the cylindrical drawn portion 7 of the work W (the cylindrical drawn molded body 5) is a thickening target region T which is planned to be finally thickened the most. The thickening target region T is set so as to contain at least part of the concave curved portion 10.

Since three thickened portions are formed in this embodiment as described above, three thickening target regions T are set. The three thickening target regions T are set in such a manner as to appear at intervals of approximately 120° in the circumferential direction with respect to the center (a specific center) of the hole-like curved portion 8 (see FIG. 2). The center of the hole-like curved portion 8, which serves as the center of the plurality of thickening target regions T, may be positioned at the center of the top portion 7*b* (on the central axis of the cylindrical drawn portion 7), or may be positioned off the center of the top portion 7*b*.

The cross-sectional views of FIG. 3A to FIG. 3D and the below-described drawings (FIG. 4A to FIG. 4D, FIG. 5A to FIG. 5D, FIG. 6A to FIG. 6D, FIG. 8A to FIG. 8D, and FIG. 9A to FIG. 9D) each indicate a cross section (hereinafter, referred to as a "central cross section") that extends through the center of the hole-like curved portion 8 and is vertical to the flat plate portion 6. In these cross-sectional views, only one of the three thickening target regions T appears.

In the step illustrated in FIG. 3C and FIG. 3D, the actual length of each of the thickening target regions T is longer than the actual length of the thickened portion in the plate-like molded body as a finished article, in the central cross section.

In the step illustrated in FIG. 3C and FIG. 3D, the work W is pressed with the punch 12 and the pad 14, and the upper die 13 is continuously moved downward while the work W is held between the punch 12 and the pad 14. In this manner, a cylindrical surface-like portion is formed in the work W by a drawing process. For this reason, the state in which the concave curved portion 10 is pressed with the punch 12 and the pad 14 is maintained during the drawing process. Therefore, the thickness of the work W in the concave curved portion 10 does not decrease in the molding process. Thus, the thickness of the work W can be ensured at a maximum before a subsequent thickening step is performed, and the thickening can be reliably performed.

Next, the cylindrical drawn portion 7 is deformed in such a manner as to be gathered toward the central axis (cylindrical axis) side, and the portion around the concave curved portion 10 of the work W is thickened. FIG. 4A to FIG. 4D are each a cross-sectional view for explaining this step.

In this step, there are used a lower die (blank holder) 16 and a punch 17 as well as first and second upper dies 18 and 19 that are paired with and disposed above these members 16 and 17.

A columnar hole penetrating in the vertical direction is formed in the lower die 16. The punch 17 is guided in this hole and movable along the axial direction of this hole. The upper surfaces of the lower die 16 and the punch 17 constitute a pressing surface 16*a* and a press surface 17*a*, respectively.

A columnar hole penetrating in the vertical direction and having the substantially same lateral cross-sectional shape and size as those of the hole of the lower die 16 is formed in the first upper die 18. The second upper die 19 is guided in this hole and movable along the axial direction of this hole. The lower surface of the first upper die 18 constitutes a pressing surface 18*a*, and faces the pressing surface 16*a* of the lower die 16. The lower surface of the second upper die 19 constitutes a press surface 19*a*, and faces the press surface 17*a* of the punch 17.

The pressing surfaces 16*a* and 18*a* are flat. The central section of the press surfaces 17*a* and 19*a* has a dome-like shape having a diameter smaller than that of the cylindrical drawn portion 7. The outer circumferential sections of the press surfaces 17*a* and 19*a* are a flat surface. In the central cross section, the actual length of the press surfaces 17*a* and 19*a* is shorter than the actual length of the portion corresponding to the press surfaces 17*a* and 19*a* in the work W as the cylindrical drawn molded body 5. The actual length of the portion facing the concave curved portion 10 of the cylindrical drawn molded body 5 in the press surfaces 17*a* and 19*a* is particularly shorter than the actual length of the concave curved portion 10.

Figure 4A:
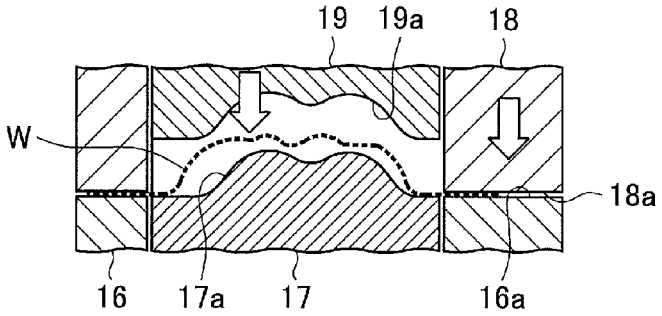
FIG. 4A is a cross-sectional view for explaining a step of deforming a cylindrical drawn portion in such a manner as to be gathered toward a central axis side and thickening a portion around a concave curved portion in the first embodiment.

With reference to FIG. 4A, the height of the pressing surface 16*a* of the lower die 16 and the height of the edge of the press surface 17*a* of the punch 17 are first aligned to be approximately the same. Then, the work W as the cylindrical drawn molded body 5 is placed on a predetermined position of the pressing surface 16*a* and the press surface 17*a*. Thereafter, a wrinkle suppressing force is allowed to act while the work W is held between the lower die 16 and the upper die 18.

Subsequently, the second upper die 19 is moved downward to be pressed against the work W. Since the diameter of the dome-like portion of the press surfaces 17*a* and 19*a* is smaller than the diameter of the cylindrical drawn portion 7, the work W is drawn in such a manner as to be gathered toward the central axis side (see FIG. 4B).

The second upper die 19 is further moved downward. Accordingly, the work W is gradually drawn toward the central axis side, and the second upper die 19 is pressed against the concave curved portion 10 of the work W (see FIG. 4C). Then, the work W is pressed with the punch 17 and the second upper die 19 (see FIG. 4D). Since the actual length of the press surfaces 17*a* and 19*a* is shorter than the actual length of the corresponding portion of the work W in the central cross section, the work W, especially, the portion around the concave curved portion 10, comes to have a decreased actual length and an increased thickness.

According to this step, the vicinity of three tops of the ring groove-like curved portion 9 having a triangular shape (see FIG. 2) is thickened the most. The direction of the most thickened portion of the work W with respect to the center of the hole-like curved portion 8 coincides with the direction of the thickening target region T, and the most thickened portion is contained in the thickening target region T.

Figure 4B:
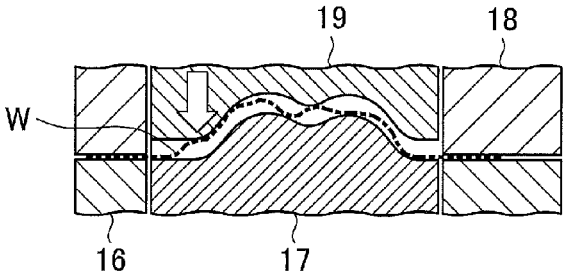
FIG. 4B is a cross-sectional view for explaining the step of deforming the cylindrical drawn portion in such a manner as to be gathered toward the central axis side and thickening the portion around the concave curved portion in the first embodiment.
Figure 4C:
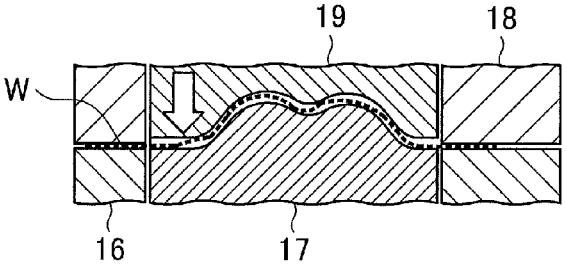
FIG. 4C is a cross-sectional view for explaining the step of deforming the cylindrical drawn portion in such a manner as to be gathered toward the central axis side and thickening the portion around the concave curved portion in the first embodiment.
Figure 4D:
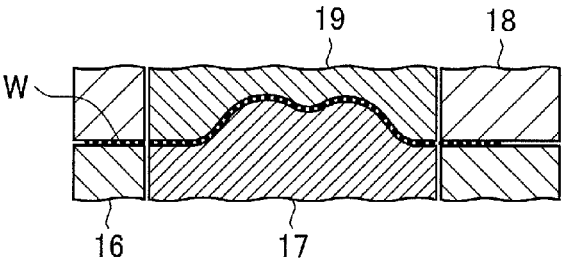
FIG. 4D is a cross-sectional view for explaining the step of deforming the cylindrical drawn portion in such a manner as to be gathered toward the central axis side and thickening the portion around the concave curved portion in the first embodiment.

In the step illustrated in FIG. 4B to FIG. 4D, the work W is pressed by the lower die 16 and the first upper die 18 with a force that allows the work W between the lower die 16 and the first upper die 18 to be adequately drawn into the space between the press surface 17*a* and the press surface 19*a*.

Next, the major portion of the thickening target region T in the work W is thickened by pressing. FIG. 5A to FIG. 5D are each a cross-sectional view for explaining this step.

In this step, there are used a lower die 21 and first and second upper dies 23 and 24 disposed above the lower die 21.

A columnar hole penetrating in the vertical direction is formed in the first upper die 23. The second upper die 24 is guided in this hole and movable along the axial direction of this hole.

A truncated cone-like protrusion 21P is formed on the top of the lower die 21. The upper surface of the lower die 21 constitutes a press surface 21*a*. On the press surface 21*a*, there is, around the protrusion 21P, a downward slope region in a direction away from the protrusion 21P. Around this downward slope region, there is a flat region arranged on the substantially same plane.

The lower surface of the second upper die 24 constitutes a press surface 24*a*, and faces the surface of the protrusion 21P and the downward slope region in the press surface 21*a*. The lower surface of the first upper die 23 constitutes a holding surface 23*a* which is flat, and faces the flat region in the press surface 21*a*.

Figure 5A:
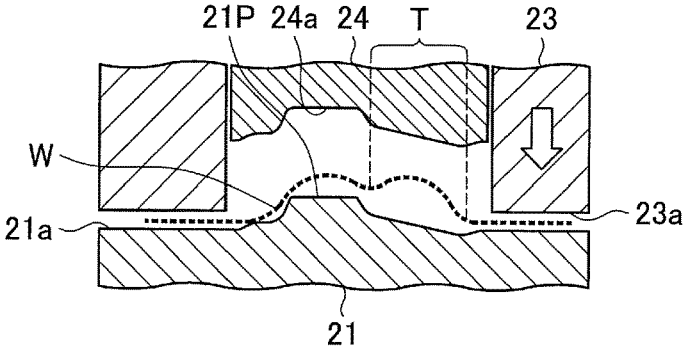
FIG. 5A is a cross-sectional view for explaining a main thickening step in the first embodiment.
Figure 5B:
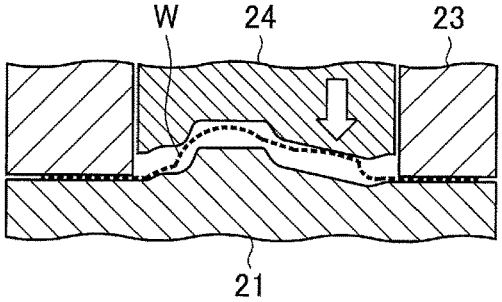
FIG. 5B is a cross-sectional view for explaining the main thickening step in the first embodiment.
Figure 5C:
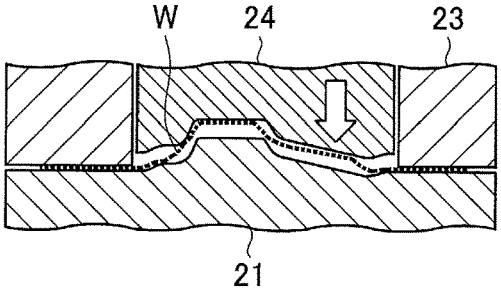
FIG. 5C is a cross-sectional view for explaining the main thickening step in the first embodiment.

Part of the downward slope region in the press surface 21*a* and the corresponding region in the press surface 24*a* correspond to the thickening target region T of a work W. As illustrated in FIG. 5A, while the thickening target region T of the work W is curved upward to a large extent in a convex shape, the corresponding regions in the press surfaces 21*a* and 24*a* are approximately flat. Therefore, in the central cross section, the actual length of the thickening target region T is longer than the actual length of the corresponding region in each of the press surfaces 21*a* and 24*a*.

When the thickening target region T is thickened, the flat portion in the outer circumferential section of the work W is first held between the lower die 21 and the first upper die 23. At this time, the work W is pressed in a sufficiently strong manner with the lower die 21 and the first upper die 23, so that even application of a force in an in-plane direction to the work W by pressing does not cause the work W to move in such a direction. Then, the second upper die 24 is moved downward to be pushed against the work W for pressing the work W with the lower die 21 and the second upper die 24.

In the central cross section, the actual length of the region corresponding to the thickening target region T in the press surfaces 21*a* and 24*a* is shorter than the actual length of the thickening target region T. Therefore, this pressing causes the work W to be deformed such that the actual length of the thickening target region T decreases (see FIG. 5B to FIG. 5D). Accordingly, the thickening target region T is thickened and becomes flat. Since the thickening target region T contains a portion that has been thickened by pressing the concave curved portion 10 (see FIG. 4A to FIG. 4D), the thickening target region T is significantly thickened compared to the initial thickness of the work W.

On the other hand, in the region other than the thickening target region T in the work W, thickening is not caused to a degree similar to that in the thickening target region T.

Thereafter, a step of adjusting the shape of the work W, the thickness of the thickening target region T, and the like is further performed. FIG. 6A to FIG. 6D are each a cross-sectional view for explaining this step. In this step, molding is performed after the molded body obtained in the previous step (FIG. 5A to FIG. 5D) is inverted using a conveyer or the like.

In this step, there are used a lower die 26 and first and second upper dies 28 and 29 disposed above the lower die 26.

A columnar hole penetrating in the vertical direction is formed in the first upper die 28. The second upper die 29 is guided in this hole and movable along the axial direction of this hole. The upper surface of the lower die 26 constitutes a press surface 26*a*. The lower surfaces of the first and second upper dies 28 and 29 constitute press surfaces 28*a* and 29*a*, respectively.

The shape of the press surface 26*a* is approximately the same as the shape obtained by aligning the positions of the holding surface 23*a* and the press surface 24*a* illustrated in FIG. 5A and vertically inversing the aligned surfaces. However, the actual length in the cross section is set to be slightly shorter than that in FIG. 5A. The shape of the press surfaces 28*a* and 29*a* is approximately the same as the shape obtained by vertically inversing the press surface 21*a* illustrated in FIG. 5A. However, while the protrusion 21P of the lower die 21 (see FIG. 5A) has a truncated cone shape as described above, a protrusion 28P corresponding to the protrusion 21P in the first upper die 28 has a cylindrical shape. In addition, the region containing a portion corresponding to the thickening target region T in the press surfaces 26*a*, 28*a*, and 29*a* partly has a different shape from that of the press surfaces 24*a* and 21*a* as described below.

The press surface 29*a* and a region facing the press surface 29*a* in the press surface 26*a* correspond to the thickening target region T of the work W. In the press surface 21*a* illustrated in FIG. 5A, the region corresponding to the thickening target region T slopes with respect to the flat portion in the outer circumference. On the other hand, in the press surface 26*a* illustrated in FIG. 6A, the region corresponding to the thickening target region T hardly slopes with respect to the flat portion in the outer circumference, and is arranged on the substantially same plane. This difference causes the thickening target region T of the work W illustrated in FIG. 6A to FIG. 6D to extend in such a manner as to slope with respect to the corresponding region of the press surfaces 26*a* and 29*a*. In addition, the actual length of the work W in this region is longer than the actual length of the press surfaces 26*a* and 29*a* in the central cross section.

Figure 5D:
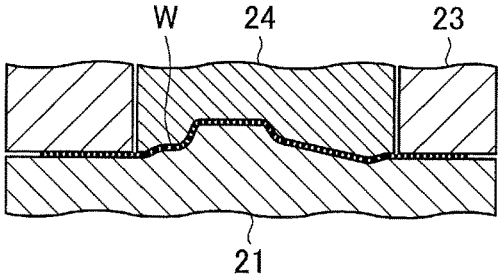
FIG. 5D is a cross-sectional view for explaining the main thickening step in the first embodiment.
Figure 6A:
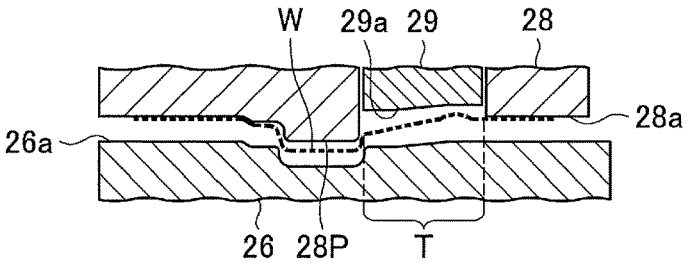
FIG. 6A is a cross-sectional view for explaining a step of adjusting the thickness of a thickening target region in the first embodiment.
Figure 6B:
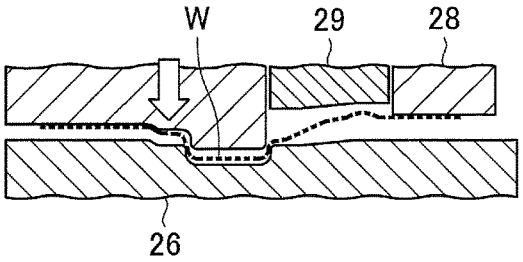
FIG. 6B is a cross-sectional view for explaining the step of adjusting the thickness of the thickening target region in the first embodiment.
Figure 6C:
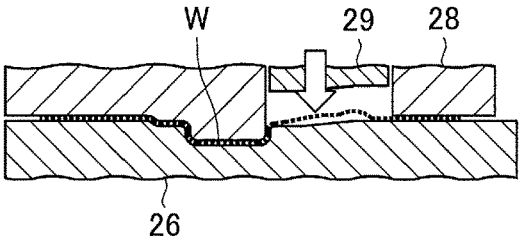
FIG. 6C is a cross-sectional view for explaining the step of adjusting the thickness of the thickening target region in the first embodiment.
Figure 6D:
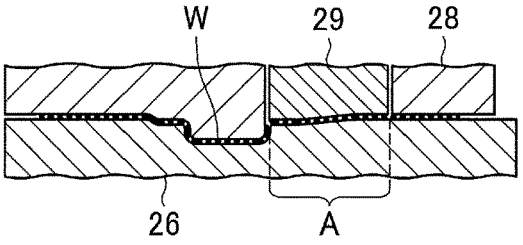
FIG. 6D is a cross-sectional view for explaining the step of adjusting the thickness of the thickening target region in the first embodiment.

For adjusting the shape of the work W and the thickness of the thickening target region T, the work W is first vertically inverted with respect to the state illustrated in FIG. 5D, and placed on the lower die 26 such that the shape of the work W follows the shape of the lower die 26. Then, the work W is pressed with the lower die 26 and the first upper die 28. The portion formed into a truncated cone shape by the protrusion 21P (see FIG. 5A) in the work W is remolded into a cylindrical shape by the protrusion 28P (see FIG. 6B and FIG. 6C).

Subsequently, while the pressing of the work W with the lower die 26 and the first upper die 28 is maintained, the thickening target region T of the work W is pressed with the lower die 26 and the second upper die 29. In the central cross section, the actual length of the region corresponding to the thickening target region T in the press surface 26*a* and the actual length of the press surface 29*a* are shorter than the actual length of the thickening target region T. For this reason, this pressing causes the actual length of the thickening target region T to decrease. As a result, the thickening target region T is thickened to become a thickened portion A. At the same time, the thickened portion A and the flat portion (the flat plate portion 6 of the cylindrical drawn molded body 5) in the outer circumferential section of the work W become in a substantially flat state as a whole (see FIG. 6D).

Two other thickening target regions T which are not illustrated in FIG. 3A to FIG. 6D are also thickened to become thickened portions A.

Consequently, there is obtained a plate-like molded body 40 including a plurality of thickened portions A in a region spaced apart from the edge in a substantially flat plate-like portion.

In the above-described embodiment, the major step for decreasing the actual length of the thickening target region T in the central cross section is the step illustrated in FIG. 5A to FIG. 5D. However, the actual length is decreased and the thickening target region T is thickened also in the step illustrated in FIG. 4A to FIG. 4D and the step illustrated in FIG. 6A to FIG. 6D. Furthermore, the step for finally achieving a flat state as a whole between the thickening target region T and the flat plate portion 6 (the flat portion in the outer circumferential section of the work W) is the step illustrated in FIG. 6A to FIG. 6D. However, the thickening target region T and the flat plate portion 6 are allowed to come into a substantially flat state as a whole also in the step illustrated in FIG. 4A to FIG. 4D and the step illustrated in FIG. 5A to FIG. 5D.

<Second Embodiment>

In this embodiment, a plate-like member including three thickened portions formed around the center is manufactured.

The cylindrical drawn molded body 5 used in the first embodiment included the hole-like curved portion 8 and the ring groove-like curved portion 9. However, a cylindrical drawn molded body including only one of the hole-like curved portion 8 and the ring groove-like curved portion 9 may be used.

Figure 7:
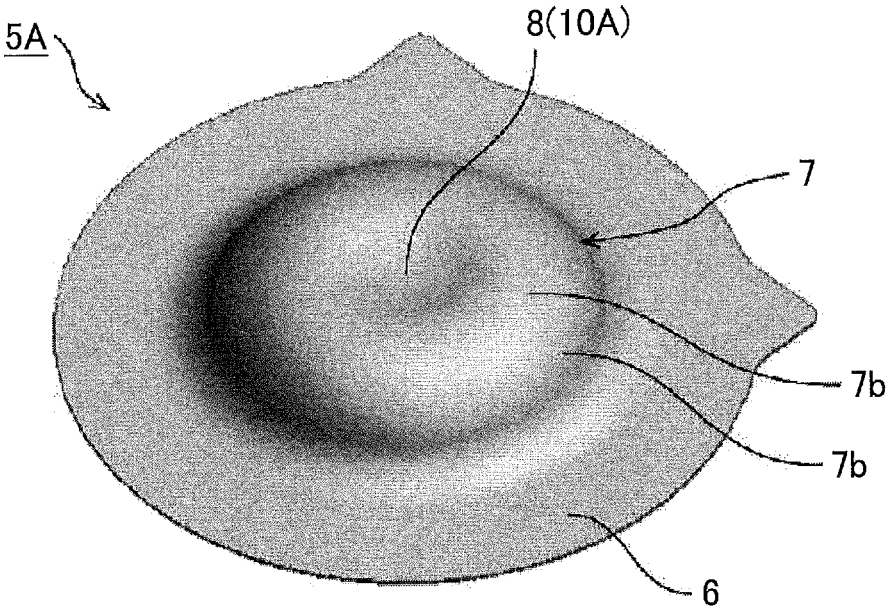
FIG. 7 is a perspective view of a cylindrical drawn molded body formed and used in a second embodiment.

FIG. 7 is a perspective view of a cylindrical drawn molded body. In FIG. 7, a portion corresponding to the component illustrated in FIG. 2 is assigned with the same reference numeral as that in FIG. 2, and the description thereof will be omitted. In the top portion 7*b* of this cylindrical drawn molded body 5A, only the hole-like curved portion 8 is formed as a concave curved portion 10A, and the ring groove-like curved portion 9 (see FIG. 2) is not formed.

Hereinafter, a method of forming such a cylindrical drawn molded body 5A and using this for manufacturing a plate-like molded body will be described.

FIG. 8A to FIG. 8D are each a cross-sectional view for explaining the drawing step. In this step, a lower die (blank holder) 31 and a punch 32 as well as an upper die 33 and a pad 34 that are paired with and disposed above the lower die 31 and the punch 32 are used for press molding to obtain the cylindrical drawn molded body 5A as an intermediate molded body.

The lower die 31, the punch 32, the upper die 33, and the pad 34 have the approximately same configurations as the lower die 11, the punch 12, the upper die 13, and the pad 14 illustrated in FIG. 3A to FIG. 3D, respectively. However, a press surface 34*a* of the pad 34 and a region facing the press surface 34*a* in a press surface 32*a* of the punch 32 have a shape corresponding to the concave curved portion 10A of the cylindrical drawn molded body 5A (see FIG. 7).

Figure 8A:
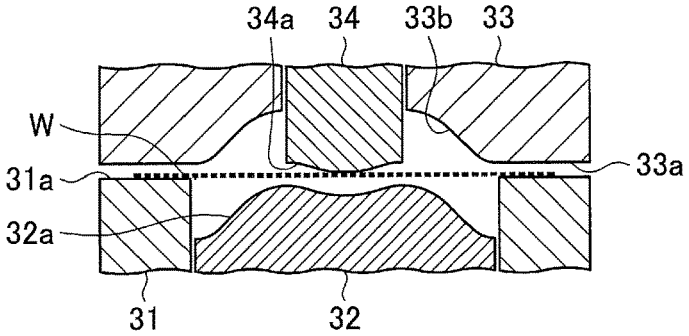
FIG. 8A is a cross-sectional view for explaining a drawing step in the second embodiment.
Figure 8B:
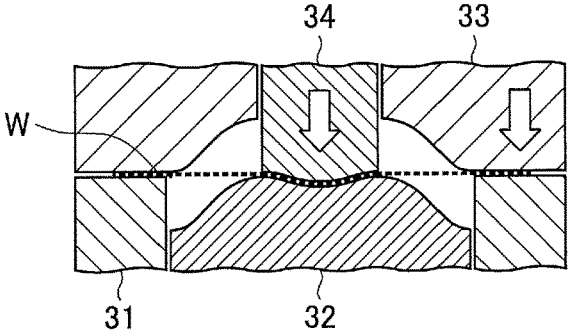
FIG. 8B is a cross-sectional view for explaining the drawing step in the second embodiment.

With reference to FIG. 8A, the upper end of the press surface 32*a* is first positioned lower than a pressing surface 31*a* of the lower die 31, and a work W is placed on the pressing surface 31*a*. Then, the work W is held between the lower die 31 and the upper die 33.

Subsequently, the upper die 33 is moved downward, so that the work W is pressed with the punch 32 and the pad 44 with a pressure given by the pad 34 attached to the upper die 33. This allows formation of the concave curved portion 10A in the central section of the work W (see FIG. 8B). At this time, the height of the concave curved portion 10A in the work W is approximately the same as the height of the other section of the work W. Furthermore, the press surface 33*b* of the upper die 33 and the region facing the press surface 33*b* of the upper die 33 in the press surface 32*a* of the punch 32 are substantially spaced apart from the work W.

Thereafter, the upper die 33 is continuously moved downward while the work W is held between the punch 32 and the pad 34 for a drawing process. Accordingly, a cylindrical surface-like portion is formed in the work W (see FIG. 8C). In association with this, the work W between the lower die 31 and the upper die 33 is drawn into the inside, that is, into a space between the outer circumferential section of the press surface 32*a* and the press surface 33*b*.

Figure 8C:
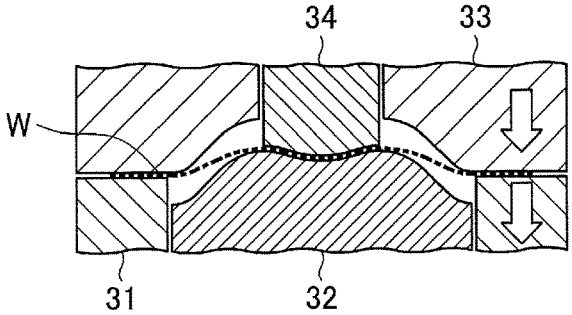
FIG. 8C is a cross-sectional view for explaining the drawing step in the second embodiment.
Figure 8D:
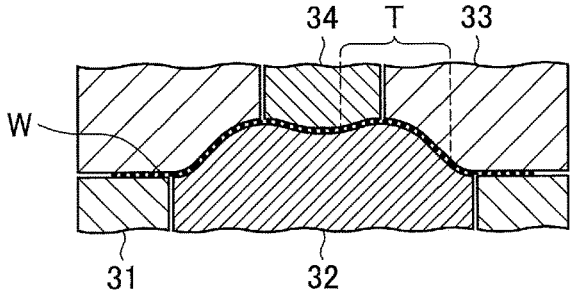
FIG. 8D is a cross-sectional view for explaining the drawing step in the second embodiment.

The upper die 33 is further continuously moved downward so that the work W is pressed with the press surface 33*b* and the outer circumferential section of the press surface 32*a* of the punch 32 (see FIG. 8D). This causes the portion between the pressing surface 31*a* of the lower die 31 and the pressing surface 33*a* of the upper die 33 in the work W becomes the flat plate portion 6. In addition, the portion between the press surface 32*a* of the punch 32, and the press surface 34*a* of the pad 34 and the press surface 33*b* of the upper die 33 becomes the cylindrical drawn portion 7. In this manner, the cylindrical drawn molded body 5A (see FIG. 7) is obtained.

In the cross section illustrated in FIG. 8D, about a right half in the cylindrical drawn portion 7 of the work W (the cylindrical drawn molded body 5) is a thickening target region T which is planned to be finally thickened the most. Since three thickened portions are formed in this embodiment as described above, three thickening target regions T are set. The three thickening target regions T are set in such a manner as to appear at intervals of approximately 120° in the circumferential direction with respect to the center (a specific center) of the hole-like curved portion 8 (see FIG. 7).

In the step illustrated in FIG. 8C and FIG. 8D, the actual length of each of the thickening target regions T is longer than the actual length of the thickened portion in the plate-like molded body as a finished article, in the central cross section.

Next, the cylindrical drawn portion 7 is deformed in such a manner as to be gathered toward the central axis side, and the portion around the concave curved portion 10A of the work W is thickened. FIG. 9A to FIG. 9D are each a cross-sectional view for explaining this step.

In this step, there are used a lower die 36 and a punch 37 as well as first and second upper dies 38 and 39 that are paired with and disposed above these members 36 and 37. The lower die (blank holder) 36, the punch 37, the first upper die 38, and the second upper die 39 have the approximately same configurations as the lower die 16, the punch 17, the first upper die 18, and the upper die 19 illustrated in FIG. 4A to FIG. 4D, respectively.

The central section of a press surface 37*a* of the punch 37 and the central section of a press surface 39*a* of the second upper die 39 have a dome-like shape having a diameter smaller than that of the cylindrical drawn portion 7. In the central cross section, the actual length of the press surfaces 37*a* and 39*a* is shorter than the actual length of a portion corresponding to the press surfaces 37*a* and 39*a* in the work W as the cylindrical drawn molded body 5A. The actual length of the portion corresponding to the concave curved portion 10A of the cylindrical drawn molded body 5A in the press surfaces 37*a* and 39*a* is particularly shorter than the actual length of the concave curved portion 10A.

Figure 9A:
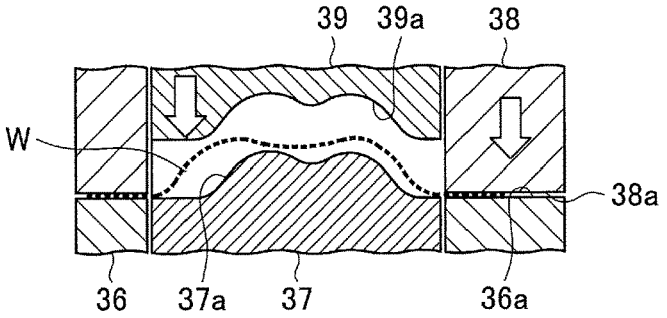
FIG. 9A is a cross-sectional view for explaining a step of deforming a cylindrical drawn portion in such a manner as to be gathered toward a central axis side and thickening a portion around a concave curved portion in the second embodiment.
Figure 9B:
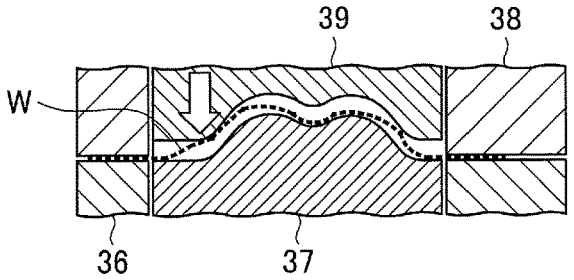
FIG. 9B is a cross-sectional view for explaining the step of deforming the cylindrical drawn portion in such a manner as to be gathered toward the central axis side and thickening the portion around the concave curved portion in the second embodiment.
Figure 9C:
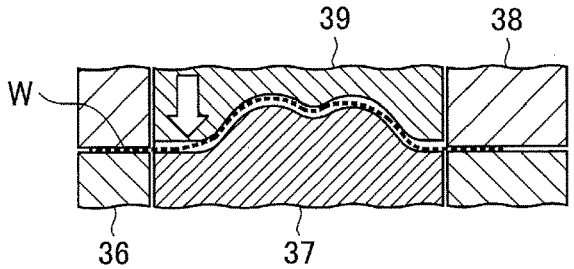
FIG. 9C is a cross-sectional view for explaining the step of deforming the cylindrical drawn portion in such a manner as to be gathered toward the central axis side and thickening the portion around the concave curved portion in the second embodiment.

With reference to FIG. 9A, the height of the pressing surface 36*a* of the lower die 36 and the height of the edge of the press surface 37*a* of the punch 37 are first aligned to be approximately the same, and a work W as the cylindrical drawn molded body 5A is placed at a predetermined position on the pressing surface 36*a* and the press surface 37*a*. Then, the work W is held between the lower die 36 and the first upper die 38.

Subsequently, the second upper die 39 is moved downward to be pressed against the work W. Since the diameter of the dome-like portion of the press surfaces 37*a* and 39*a* is smaller than the diameter of the cylindrical drawn portion 7, the work W is deformed in such a manner as to be gathered toward the central axis side (see FIG. 9B).

Figure 9D:
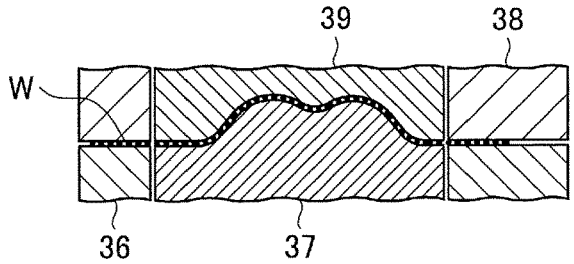
FIG. 9D is a cross-sectional view for explaining the step of deforming the cylindrical drawn portion in such a manner as to be gathered toward the central axis side and thickening the portion around the concave curved portion in the second embodiment.

Furthermore, the second upper die 39 is moved downward to press the second upper die 39 against the concave curved portion 10A of the work W (see FIG. 9C), so that the work W is pressed with the punch 37 and the second upper die 39 (see FIG. 9D). Since the actual length of the press surfaces 37*a* and 39*a* is shorter than the actual length of the corresponding portion of the work W in the central cross section, the work W, especially, the portion around the concave curved portion 10A, comes to have a decreased actual length and an increased thickness.

However, since the concave curved portion 10A does not contain the ring groove-like curved portion 9 (see FIG. 2), the thickening rate of the thickening target region T by the above-described step is smaller than the thickening rate of the thickening target region T in the step illustrated in FIG. 4B to FIG. 4D.

Thereafter, steps similar to the step illustrated in FIG. 5A to FIG. 5D and the step illustrated in FIG. 6A to FIG. 6D according to the first embodiment are performed. Consequently, there is obtained a plate-like molded body including a plurality of thickened portions in a region spaced apart from the edge in a substantially flat plate-like portion.

However, since the thickening by pressing the ring groove-like curved portion 9 is not obtained, the thickening rate of the thickened portion obtained in the manufacturing method according to the second embodiment is smaller than the thickening rate of the thickened portion obtained by the manufacturing method according to the first embodiment. However, even in the second embodiment, the thickened portion has a thickening rate of 20% or more with respect to an initial plate thickness as the plate thickness of the cylindrical drawn molded body, and has a length of five times or more the initial plate thickness in the central cross section.

In the above description, when press is performed with a lower mold and an upper mold, the upper mold may be moved downward instead of moving the lower mold upward, and the lower mold may be moved upward instead of moving the upper mold downward.

As described above, in the thickening step, the actual length of the thickening target region T is decreased while wrinkles generated by out-of-plane deformation during molding are suppressed. Accordingly, the thickening target region T is thickened to become a thickened portion. Also, in the thickening step, the thickening target region T and the flat plate portion (the outer circumferential section of the cylindrical drawn molded body) come into a flat state as a whole. For this reason, according to this method, there can be manufactured a plate-like molded body having a thickened portion in a region spaced apart from the edge in a substantially flat plate-like portion.

In addition, two or more thickening target regions T are set along the circumferential direction with respect to a specific center. Therefore, according to this method, there can be manufactured a plate-like molded body on which a plurality of thickened portions appear along the circumferential direction with respect to the center.

Furthermore, the actual length of the concave curved portion 10 is longer than that of the cross section that does not include a concave curvature. Since the thickening target region T is formed in a region containing at least part of the concave curved portion 10, the concave curved portion 10 is thickened particularly thickly in the thickening target region T by pressing in the thickening step.

Figure 10:
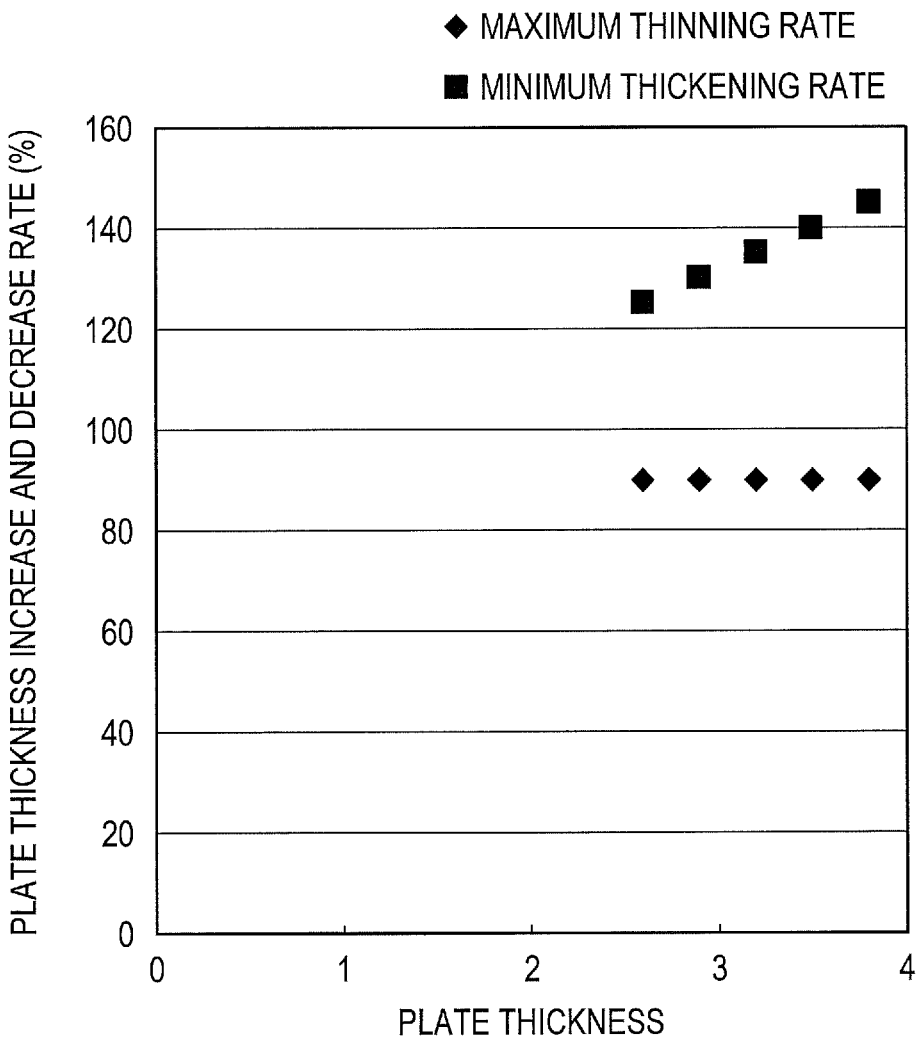
FIG. 10 is a characteristics diagram illustrating a relationship between a standard plate thickness t [mm] of a cylindrical drawn molded body, a plate thickness ti [mm] of a thickened portion, and a plate thickness td [mm] of a thinned portion having been thinned compared to the standard plate thickness.

FIG. 10 is a characteristics diagram illustrating plate thicknesses of the cylindrical drawn molded bodies 5 and 5A. When the cylindrical drawn molded bodies 5 and 5A are manufactured according to the above-described embodiments, the plate thickness in the thickened portion A is increased compared to the plate thickness before processing (standard plate thickness). On the other hand, in the region suppressed by the pad 14 during processing, the material hardly flows out from the space between the punch 12 and the pad 14 toward the outer circumference, but the region is slightly thinned in some cases. In addition, an unthickened region around the region suppressed by the pad 14 is also slightly thinned in some cases. These regions having been thinned are referred to as a thinned portion. Measurement of the plate thicknesses of the cylindrical drawn molded bodies 5 and 5A indicated that a standard plate thickness t [mm], a plate thickness ti [mm] of a thickened portion, and a plate thickness td [mm] of a thinned portion that is thinner than the standard plate thickness have a relationship illustrated in FIG. 10 and the table below. Here, the standard plate thickness is the plate thickness of a region excluding the thickened portion and the thinned portion in each of the cylindrical drawn molded bodies 5 and 5A.

TABLE 1

| Standard plate thickness | Maximum thinning rate | Minimum thickening rate |
|---|---|---|
| 2.6 | 90% | 125% |
| 2.9 | 90% | 130% |
| 3.2 | 90% | 135% |
| 3.5 | 90% | 140% |
| 3.8 | 90% | 145% |

Therefore, according to the manufacturing methods of the above-described embodiments, there can be molded a plate-like molded body in which when t [mm] is a standard plate thickness, a plate thickness ti [mm] of a thickened portion and a plate thickness td [mm] of a thinned portion satisfy relational formulae below:

when $2.0<t<3.0$, $td \geq 0.9t$, $ti \geq 1.25t$, when $3.0<t<4.0$, $td \geq 0.9t$, $ti \geq 1.35t$, and when $4.0<t<5.0$, $td \geq 0.9t$, $ti \geq 1.45t$.

Thus, according to the manufacturing methods of the above-described embodiments, the thickened portion having been thickened with respect to the standard plate thickness and the thinned portion having been slightly thinned with respect to the standard plate thickness are formed depending on the standard plate thickness. The maximum thinning rate in the thinned portion is approximately 90%, which demonstrates that the outflow of the material is suppressed to a minimum. Therefore, according to the above-described embodiments, molding in a state in which a material is held between the punch 12 and the pad 14 enables molding of the cylindrical drawn molded bodies 5 and 5A that suppress the outflow of the material in the thinned portion and that are thickened by 25% or more in the thickened portion.

It should be understood by those skilled in the art that various modifications, combinations, sub-combinations and alterations may occur depending on design requirements and other factors insofar as they are within the scope of the appended claims or the equivalents thereof.

REFERENCE SIGNS LIST

5, 5A cylindrical drawn molded body
6 flat plate portion
7 cylindrical drawn portion
7*b* top portion
8 hole-like curved portion
9 ring groove-like curved portion
10, 10A concave curved portion
11, 31 lower die
13, 33 upper die
12, 32 punch
14, 34 pad
40 plate-like molded body
A thickened portion
T thickening target region
W work (body to be processed)

The invention claimed is:

1. A method of manufacturing a molded body having a plurality of thickened portions, comprising at least a drawing step of obtaining by a drawing process a cylindrical drawn molded body including a flat plate portion and a cylindrical drawn portion that swells in such a manner as to project from the flat plate portion and has a circular top portion, wherein the drawing step includes a first step of pressing a region spaced apart from an edge in a member having a flat plate shape, with a first mold and a second mold, to form a concave curved portion in the member, and a second step of holding an outer circumferential section of the member between a third mold and a fourth mold while a region containing the concave curved portion in the member is held between the first mold and the second mold, and moving the first mold and the second mold relative to the third mold and the fourth mold to cause the region containing the concave curved portion to project with respect to the outer circumferential section and to obtain the cylindrical drawn molded body, wherein each thickened portion out of said plurality of thickened portions has a plate thickness with a thickening rate of 20% or more with respect to an initial plate thickness as a plate thickness of the cylindrical drawn molded body, and has a length of five times or more the initial plate thickness in a cross section that is vertical to the flat plate potion and contains a specific center in a region corresponding to the cylindrical drawn portion.

2. The method of manufacturing the molded body according to claim 1, wherein the first step includes forming the concave curved portion in a region corresponding to the top portion, and wherein the second step includes setting a plurality of thickening target regions containing at least a part of the concave curved portion along a circumferential direction with respect to the specific center in the region corresponding to the cylindrical drawn portion, and performing a drawing process such that in the cross section, an actual length of the thickening target region becomes longer than an actual length of each thickened portion out of said plurality of thickened portions in the molded body.

3. The method of manufacturing the molded body according to claim 2, further comprising, after the drawing step, a thickening step of pressing the cylindrical drawn molded body such that an actual length of each of the thickening target regions in the cross section decreases, and the thickening target region and the flat plate portion finally become flat as a whole.

4. The method of manufacturing the molded body according to claim 1, wherein the concave curved portion includes a curved portion that is curved in a hole shape.

5. The method of manufacturing the molded body according to claim 4, wherein the concave curved portion further includes a ring curved portion that is curved in a groove shape and formed around the curved portion in such a manner as to have a polygonal shape as a whole when seen vertically to the flat plate portion.

6. The method of manufacturing the molded body according to claim 1, wherein the concave curved portion includes a ring curved portion that is curved in a groove shape and formed in such a manner as to have a polygonal shape as a whole when seen vertically to the flat plate portion.

7. The method of manufacturing the molded body according to claim 1, further comprising a third step of holding the flat plate portion between a fifth mold and sixth mold, and pressing the cylindrical drawn molded body with a seventh mold and an eighth mold each having a dome shaped portion of a pressing surface whose diameter is smaller than the cylindrical drawn portion for forming the portion around the concave portion to have a decreased length and increased thickness.

8. A molded body having a plurality of thickened portions, manufactured by the method of manufacturing a molded body according to claim 1, comprising:

a flat plate portion; and a cylindrical drawn portion that swells in such a manner as to project from the flat plate portion and has a circular top portion, wherein when t [mm] is a standard plate thickness, a plate thickness ti [mm] of the thickened portion and a plate thickness td [mm] of a thinned portion having a smaller thickness than the standard plate thickness satisfy relational formulas below:

when $2.0<t<3.0$, $td \geq 0.9t$, $ti \geq 1.25t$, and when $3.0<t<4.0$, $td \geq 0.9t$, $ti \geq 1.35t$.

* * * * *